United States Patent [19]

Reifenhauser

[11] Patent Number: 5,032,329

[45] **Date of Patent: * Jul. 16, 1991**

[54] METHOD OF MAKING A FLEECE FROM SPUN FILAMENTS

[75] Inventor: Hans Reifenhauser, Troisdorf, Fed. Rep. of Germany

[73] Assignee: Reifenhauser GmbH & Co. Maschinenfabrik, Troisdorf, Fed. Rep. of Germany

[ * ] Notice: The portion of the term of this patent subsequent to Apr. 11, 2006 has been disclaimed.

[21] Appl. No.: 322,735

[22] Filed: Mar. 18, 1989

Related U.S. Application Data

[63] Continuation-in-part of Ser. No. 119,465, Nov. 10, 1987, abandoned.

[30] Foreign Application Priority Data

Apr. 25, 1987 [DE] Fed. Rep. of Germany ..... 3713861

[51] Int. Cl.[5] ..... D01D 5/12

[52] U.S. Cl. ..... 264/40.5; 264/40.2; 264/40.3; 264/210.8; 264/555

[58] Field of Search ..... 264/40.1, 40.3, 40.5, 264/40.6, 40.7, 555, 40.2, 210.8; 156/167, 350; 425/66, 80.1, 83.1

[56] References Cited

U.S. PATENT DOCUMENTS 4,003,105 1/1977 Guschin et al. ..... 425/80.1
4,520,531 6/1985 Hergeth ..... 19/105
4,692,106 9/1987 Grabowski et al. ..... 425/66
4,820,459 4/1989 Reifenhauser ..... 264/40.3

FOREIGN PATENT DOCUMENTS 2260135 6/1974 Fed. Rep. of Germany .
53-10624 4/1978 Japan ..... 264/40.7

*Primary Examiner*—Robert A. Dawson
*Assistant Examiner*—Allan R. Kuhns
*Attorney, Agent, or Firm*—Herbert Dubno; Andrew Wilford

[57] ABSTRACT

An apparatus for making a fleece comprises a horizontally elongated upright passage, flaps defining a stretching gap between the walls, and respective lower flaps have upper edges pivotal by actuators on the walls. A foraminous conveyor belt extends horizontally immediately underneath the passage and is advanced generally continuously horizontally past the passage. An array of spinnerets in the upper end of the passage forms filaments that move downward in the passage and that deposit on the moving conveyor as cool air is introduced into the upper end of the passage and is withdrawn from the passage through the lower end thereof and through the foraminous belt. The deposited length of the filaments on the belt downstream of the lower passage end is continuously monitored and an output corresponding thereto is generated and is compared with a set point and the lower flaps are pivoted to move their lower edges away from one another when the output of the sensor means exceeds the set point and vice versa.

6 Claims, 1 Drawing Sheet

CON TROLLER

METHOD OF MAKING A FLEECE FROM SPUN FILAMENTS

CROSS REFERENCE TO RELATED APPLICATION

This application is a continuation-in-part of copending patent application 119,465 filed 10 Nov. 1987, now abandoned.

FIELD OF THE INVENTION

The present invention relates to making a fleece. More particularly this invention concerns the manufacture of a fleece from spun filaments.

BACKGROUND OF THE INVENTION

A spun-filament fleece can be made in a device which includes a spinning nozzle system or spinneret, a cooling shaft, a stretching gap, a diffuser shaft, a continuously moving filament-receiving conveyor, and a device for feeding process air to the cooling shaft and for drawing exiting air through the mat-receiving conveyor. The cooling shaft has a shaft wall provided with a plurality of air orifices and the process air required for cooling is introduced through the air orifices to provide an air flow in the shaft that is at least partially drawable through the mat-forming conveyor.

A critical feature of a mat thus formed is the so-called deposited length which determines the thickness and appearance of the finished mat. More particularly it is noted that the filaments are generated and formed at a linear speed that is many times greater than the speed which the mat-receiving belt moves at. Thus these filaments will not extend in straight lines on the mat but instead will normally fall as coils or successions of loops. When the loops are elongated in the direction of displacement of the belt the deposited length is long, and when they are elongated transverse to this direction the deposited lenght is short. When the loops are transversely elongated, that is when the deposited length is short, the goods will be thicker and when they are elongated in the mat-travel direction the mat thus produced will be less thick.

According to the features of the known filament-spinning device the deposited lengths of filament loops which substantially determine the quality of the manufactured spun-filament fleece adjust themselves according to the flow rate of thermoplastic material which forms the endless filaments, in accordance with the flow rate of the process air, with the flow rate of exiting air, and with the geometry of the filament-spinning device and other parameters. If one keeps the described parameters constant, the deposited lengths of the filament loops cannot be readily changed particularly in regard to the spun-filament fleece thickness. If one changes the given parameters to adjust the deposited lengths, complex and not easily reproducible structures result.

In German patent document 2,260,135 filed 08 Dec. 1972 by Rudolf Brauer et al a system is described where the cooling shaft is constructed as a vertical venturi having relative to the direction of travel of the mat-receiving conveyor band a downstream wall and an upstream wall. The deposited length of the filaments in this case is controlled by changing the venturi shape by tilting the walls relative to one another. When the walls are made to diverge downward the result is a long deposited length and when they converge downward the deposited length is shorter.

OBJECTS OF THE INVENTION

It is therefore an object of the present invention to provide an improved method of and apparatus for making a mat or fleece of spun filaments.

Another object is the provision of such an improved method and apparatus which overcome the above-given disadvantages, that is in which the deposited lengths of the endless filament loops are easily and reproducibly changed in the spinning unit.

A further object is to provide an improved mat-making system where the mat is of extremely accurate uniformity.

SUMMARY OF THE INVENTION

The instant invention is therefore a method of operating an apparatus for making a fleece which comprises a horizontally elongated upright passage having an upper end, a lower end, and a pair of spaced and stationary walls each with an upper portion, an intermediate portion, and a lower portion. Flaps or the like are provided between the upper and intermediate portions and have lower edges defining a stretching gap and respective lower flaps have upper edges pivotal on the walls about horizontal axes between the intermediate and lower portions and lower edges. Actuators can pivot the lower flaps about the respective axes and a foraminous conveyor belt extends horizontally immediately underneath the passage and is advanced generally continuously horizontally past the passage. An array of spinnerets in the upper end of the passage forms filaments that move downward in the passage and that deposit on the moving conveyor as cool air is introduced into the passage through the upper-wall portions and is withdrawn from the passage through the lower end thereof and through the foraminous belt to cool and harden the spun filaments. According to this invention the deposited length of the filaments on the belt downstream of the lower passage end is continuously monitored and an output corresponding thereto is generally continuously generated so that the output increases as deposited length and web thickness increases and vice versa. The output is compared with a set point and the lower flaps are pivoted to move their lower edges away from one another when the output of the sensor means exceeds the set point and to move the lower edges of the lower flaps toward each other when the output of the sensor means is less than the set point.

Thus with this system the apparatus automatically and dynamically adjusts the deposited length to produce a workpiece of very uniform thickness. The system is wholly automatic and can even compensate for local malfunctionings in the equipment.

According to a further feature of this invention the deposited length is measured at a plurality of measurement locations spaced apart transversely of the displacement direction of the belt and the flaps are elastically deformed at respective locations directly upstream of the measurement locations in accordance with the respective outputs. Thus one part of a flap can be bent out while and adjacent part is bent in and so on.

The apparatus of this invention also has intermediate portions that are convex toward one another but there are respective downwardly converging upper flaps having upper edges connected to the walls between the respective upper and intermediate portions and lower edges defining a gap so that this system does not work in accordance with the venturi principle of the abovementioned Brauer document. Instead the upper flaps induce turbulence which is the opposite of the smooth flow of Brauer.

The apparatus further comprises a plurality of individual deposited-length sensors spaced apart transversely of the belt displacement direction and a plurality of respective actuators connected to the flaps directly upstream of the respective sensors. The controller operates the actuators in accordance with the respective outputs to deform the flaps.

DESCRIPTION OF THE DRAWING

The above and other objects, features, and advantages will become more readily apparent from the following, reference being made to the accompanying drawing in which.

SPECIFIC DESCRIPTION

Figures 1, 2:
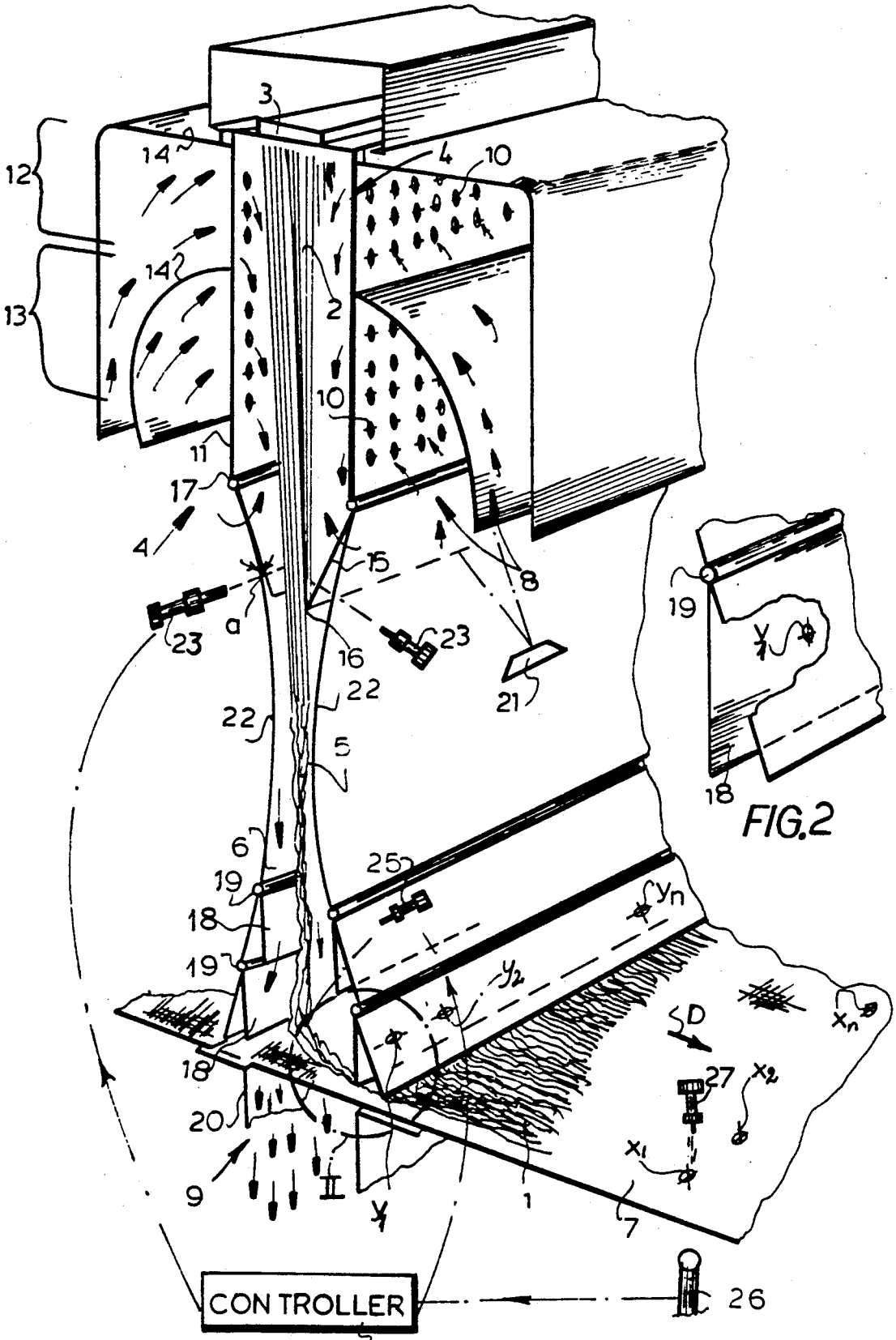
FIG. 1 is a partly diagrammatic perspective view partly in vertical section of a mat-making apparatus according to my invention.
FIG. 2 is an enlarged sectional perspective view of the detail indicated by dot-dash circle II in FIG. 1.

As seen in FIGS. 1 and 2 the device or apparatus according to the invention produces a spun-filament fleece or mat 1 made from endless synthetic resin filaments 2 generated by a spinning nozzle system or spinneret 3 which opens into the upper end of a cooling shaft 4. A stretching gap 5 and a diffuser shaft 6 form a downward extension of the shaft 4 and a conveyor 7 receives the mat 1.

Process air is fed into the upper end of the shaft 4 from plenums 8 and is withdrawn through the mat 7 from the bottom of the shaft 4 by a return 9. The cooling shaft 4 has a pair of parallel and vertical upper shaft walls 11 provided with air orifices 10 by means of which the process air enters this shaft 4 from the plenums 8. These walls 11 can also each be formed as a screen or grid.

The cooling shaft 4 has in its upper end portion at the walls 11 an upper intensive cooling region 12 and a lower additional cooling region 13 defined in the plenums by air-flow dividing guiding walls or baffles 14 connected to the outside surfaces of the shaft walls 11. The guiding walls 14 can be moved where they contact the walls 11 vertically to vary the relative size of the zones 12 and 13 which are fed air of different temperatures, from a blower indicated schematically at 21.

Air control flaps 15 converging downward in the feed direction of the endless filaments 2 are connected to the shaft wall 11 at the upper end of the inwardly convex walls 22 forming the stretching gap 5. These flaps 15 define at their lower edges an outlet gap 16 which defines the upstream end of the stretching gap 5. These air control flaps 15 define with the walls 22 a downwardly open adjustable setting angle a and are movable about respective horizontal axes 17 by schematically illustrated actuators 23 connected to a controller 24. The structure is designed so that the setting angle a and thus the width of the outlet gap 16 is adjustable differently over the entire length of the air control flap 15 in a horizontal direction. Thus each of the flaps 15 is elastically deformable and has a plurality of such actuators 23.

The diffuser shaft 6 formed at the downstream end of the stretching gap 5 is provided with two vertically spaced pairs of pivotable flaps 18 substantially identical to the flaps 15 and defining a flow cross section. These flaps 18 are movable about respective horizontal axes 19 by respective pluralities of actuators 25 arranged like the actuators 23 along the length of these elastically deformable flaps 18. The flaps 18 are adjustable independently of each other.

The return 9 for drawing in air has a pair of slides 20 below the mat-receiving conveyor 7 and displaceable in the travel direction D of the mat 7. Such slides 20 can also be provided above the conveyor 7. Thus the width of the exiting air flow measured in the transport direction D of the mat-receiving conveyor 7 is adjustable. The return or intake device 9 can be connected to the input of the blower 21 whose output passes over two different coolers (not illustrated) to the cold upper compartment 12 and warmer lower compartment 13. Thus the apparatus according to my invention does not operate with three separate air flows but with a single process air flow which, as described, is divided into a partial flow of air for the intensive cooling region 12 and a partial air flow for the additional cooling region 13.

In the described filament-spinning device the deposited length of the endless filament loops can be dynamically adjusted as the web 1 is being produced. Furthermore the deposited length of the filament loops is measured in the spun-filament fleece 1 over the spun-filament fleece width and the measured value is compared with a predetermined set-point value. The measurement can be a mean or average value. Particularly the measurement of the deposited length can be performed by individual photoelectric sensors 26 positioned underneath the web 1 underneath respective light sources 27 at measuring points $x_1, x_2, \ldots, x_n$ distributed over the entire width of the spun-filament fleece. The sensors 26 are connected to the controller 24 and generate respective analog outputs corresponding to how much light gets through the fleece 1 which is itself proportional to the thickness of this web 1 which is in turn a function of the deposited length. It would also be within the scope of this invention to actually touch and measure the web thickness at the various points $x_1, x_2, \ldots, x_n$ or even to weigh the web to determine deposited length.

An average value can be obtained from the outputs of these sensors 27 by integrating the analog signals and these averages can are compared to set points derived from a reference-signal generator to derive error signals that are in turn used to control the setting angles a of the pivoting flaps 18 at corresponding adjusting points $y_1, y_2, \ldots, y_n$. These flaps are deformable elastically as mentioned above to control the deposited length in such a manner that the actual values from the sensors 26 correspond to the set points, which are all the same in virtually all cases.

I claim:

1. In a process for making a spun-filament fleece in a filament-spinning device comprising a spinning nozzle system emitting filaments, a cooling shaft receiving filaments from the system and having a shaft wall formed with a plurality of air orifices, a stretching gap through which the filaments pass, a diffuser shaft through which the filaments pass and having a wall and an outlet partially formed by a flap pivotal about a horizontal axis and forming with the wall a setting angle, a continuously moving mat-receiving conveyor, a device for feeding process air through the orifices into the shaft and for drawing air out through the mat-receiving conveyor to deposit the filaments on the conveyor as loops forming a fleece, the improvement wherein;

the thickness of the fleece is measured at a plurality of different measuring points $x_1, x_2, \ldots, x_n$ spaced apart transversely of the direction of displacement of the conveyor;

the measured values of the fleece thickness are compared with a set-point value; and on deviation of a one of the measured values from the set-point value the setting angle is changed at a respective one of a plurality of adjusting points $y_1, y_2, \ldots y_n$ corresponding to the measuring points $x_1, x_2, \ldots x_n$ so that, on a positive deviation of a one of the measured values from the set-point value corresponding to the fleece thickness being larger than the set-point value, the setting angle at the respective adjusting point is reduced.

2. The improved process for making a spun-filament fleece defined in claim 1 wherein the filament-spinning device has at least two opposing such pivoting flaps at least on one side of the diffuser shaft and the setting angle of only one of the pivoting flaps is changed.

3. The improved process for making a spun-filament fleece defined in claim 1 wherein the filament-spinning device has at least two opposing such pivoting flaps on both sides of the diffuser shaft and both the pivoting flaps have their angles changed.

4. The improvement defined in claim 3 wherein the pivoting flaps are moved synchronously.

5. The improvement defined in claim 1 wherein the pivoting flaps are elastically deformed for adjustment of the respective angles at the respective adjusting points.

6. A method of operating an apparatus for making a fleece, the apparatus comprising:

a horizontally elongated upright passage having an upper end, a lower end, and a pair of spaced and stationary walls each with an upper portion, an intermediate portion, and a lower portion;

means between the upper and intermediate portions and lower edges defining a stretching gap;

respective lower flaps having upper edges pivotal on the walls about horizontal axes between the intermediate and lower portions and lower edges;

actuator means for pivoting the lower flaps about the respective axes;

a foraminous conveyor belt extending horizontally immediately underneath the passage;

means for advancing the belt generally continuously horizontally past the passage;

means including an array of spinnerets in the upper end of the passage for forming in the passage filaments that move downward in the passage and that deposit on the moving conveyor; and means for introducing cool air into the passage through the upper-wall portions and for withdrawing the air from the passage through the lower end thereof and through the foraminous belt; the method comprising the steps of:

measuring the thickness of the fleece on the belt downstream of the lower passage end at a plurality of different measuring locations spaced apart transversely of the direction of displacement of the conveyor and generally continuously generating respective outputs corresponding thereto; and comparing the outputs with a set point and pivoting the lower flaps at a plurality of adjusting locations corresponding to the measuring locations to move their lower edges at the respective adjusting locations away from one another when the respective output exceeds the set point and for moving the lower edges of the lower flaps at the respective adjusting locations toward each other when the respective output is less than the set point.

* * * * *